United States Patent [19]

Schemenau et al.

[11] Patent Number: 4,845,942

[45] Date of Patent: Jul. 11, 1989

[54] COMBINED GAS TURBINE AND STEAM POWER PLANT HAVING A FLUIDIZED BED FURNACE FOR GENERATING ELECTRICAL ENERGY

[75] Inventors: Wolfgang Schemenau, Laudenbach; Jürgen Bennert, Gorxheimertal; Dietrich Ceelen, Grünstadt, all of Fed. Rep. of Germany

[73] Assignee: Brown, Boveri & CIE, Mannheim, Fed. Rep. of Germany

[21] Appl. No.: 37,618

[22] Filed: Apr. 13, 1987

[30] Foreign Application Priority Data

Apr. 19, 1986 [DE] Fed. Rep. of Germany ..... 3613300

[51] Int. Cl.[4] ..... F02C 3/26; F02B 43/08

[52] U.S. Cl. ..... 60/39.12; 60/39.182; 60/39.464; 122/4 D

[58] Field of Search ..... 60/39.12, 39.182, 39.464; 122/4 D; 110/211, 263; 431/5

[56] References Cited

U.S. PATENT DOCUMENTS

| | | | |
|---|---|---|---|
| 3,446,012 | 5/1969 | Foster-Pegg | 60/39.12 |
| 4,253,300 | 3/1981 | Willyoung | 60/39.464 |
| 4,369,624 | 1/1983 | Hamm et al. | 60/39.12 |
| 4,387,560 | 6/1983 | Hamilton et al. | 60/39.182 |
| 4,476,674 | 10/1984 | Berman | 60/39.464 |

FOREIGN PATENT DOCUMENTS

| | | | |
|---|---|---|---|
| 3428041 | 1/1986 | Fed. Rep. of Germany | 60/39.464 |
| 2076062 | 11/1981 | United Kingdom | 60/39.182 |
| 2095762 | 10/1982 | United Kingdom | 60/39.182 |

*Primary Examiner*—Donald E. Stout

*Attorney, Agent, or Firm*—Herbert L. Lerner; Laurence A. Greenberg

[57] ABSTRACT

A combined gas turbine and steam power plant for generating electrical energy includes a combustion chamber for the complete combustion of solid fuels with the aid of a stationary fluidized bed generating steam for the operation of the steam power plant, the combustion chamber having a nozzle bottom, a fuel delivery point above the nozzle bottom, and a wall with at least one opening formed therein for the removal of combustible gas produced from a fuel degasification and gasification zone forming during operation in the fluidized bed in the vicinity of the fuel delivery point, a combustor of the gas turbine plant in which compressed air required for the operation of the gas turbine is heated by combustion of combustible gas, and a combustible gas line connected between the at least one opening and the combustor.

3 Claims, 2 Drawing Sheets

COMBINED GAS TURBINE AND STEAM POWER PLANT HAVING A FLUIDIZED BED FURNACE FOR GENERATING ELECTRICAL ENERGY

The invention relates to a combined gas turbine and steam power plant having a fluidized bed furnace for generating electrical energy.

In a plant of this type which is known from U.S. Pat. No. 4,387,560, steam is generated with the aid of a fluidized bed furnace and is then delivered to a steam turbine. The steam is expanded and the mechanical power produced is delivered to an electric generator for generating electric current. At the same time, in the associated gas turbine plant, ambient air is aspirated and compressed by a compressor, heated in a heat exchanger disposed in the fluidized bed furnace, heated further in a combustor disposed downstream and then delivered to a gas turbine, which drives another electric generator. A combustible gas that is generated in a separate gasifier is used for heating the air in the combustor. To this end, all of the fuel required for operating the fluidized bed furnace is delivered to the separate gasifier and the degasified fuel is introduced into the fluidized bed furnace for burning. Generating the combustible gas in the separate gasifier is very labor and cost-intensive, especially since all of the fuel must be delivered to the gasifier. Furthermore, additional means are required for supplying the gas generator with the heat that it requires for its operation.

It is accordingly an object of the invention to provide a combined gas turbine and steam power plant having a fluidized bed furnace for generating electrical energy, which overcomes the hereinafore-mentioned disadvantages of the heretofore-known devices of this general type and in which the combustible gas can be obtained with less effort and thus at favorable cost from the fuel of the fluidized bed furnace.

With the foregoing and other objects in view there is provided, in accordance with the invention, a combined gas turbine and steam power plant for generating electrical energy, comprising a combustion chamber for the complete combustion of solid fuels with the aid of a stationary fluidized bed generating steam for the operation of the steam power plant, the combustion chamber having a nozzle bottom, a fuel delivery point above the nozzle bottom, and a wall with at least one opening formed therein for the removal of combustible gas produced from a fuel degasification and gasification zone forming during operation in the fluidized bed in the vicinity of the fuel delivery point, a combustor of the gas turbine plant in which compressed air required for the operation of the gas turbine is heated by combustion of combustible gas, and a combustible gas line connected between the at least one opening and the combustor.

If the fluidized bed furnace of the steam power plant has a stationary fluidized bed which fills only part of the combustion chamber and has a surface that extends approximately horizontally, then the fuel degasification or gasification zone of the fluidized bed is utilized for furnishing the combustible gas for the combustor of the gas turbine plant. This zone forms during operation of the fluidized bed in the vicinity of the fuel delivery point above the nozzle bottom. Accordingly, these zones are merely required to communicate with the gas burner of the combustor. The result is a plant of unexcelled simplicity.

In order to ensure that the combustible gas produced in the gasification or degasification zone can be drawn off as uniformly as possible and in sufficient quantity, it is best if a plurality of openings for drawing off gas are provided in the combustion chamber wall. Therefore, in accordance with another feature of the invention, the at least one opening is in the form of a plurality of openings disposed substantially along a horizontal plane and uniformly distributed about the periphery of the combustion chamber wall.

Sufficient combustible gas can be drawn from the above-mentioned zones if the openings in this way. In accordance with a further feature of the invention, the at least one opening is disposed above the fuel delivery point or the fuel delivery plane.

In accordance with an added feature of the invention, the fluidized bed has a given vertical thickness, and the at least one opening is vertically spaced from the fuel delivery point by substantially between 1/5 and 1/15 of the given vertical thickness. This provides the best vertical spacing between the gas removal openings and the fuel delivery point.

With the objects of the invention in view, there is also provided a combined gas turbine and steam power plant for generating electrical energy, comprising a combustion chamber for the complete combustion of solid fuels with the aid of a circulating fluidized bed, which serves for generating steam for the steam power plant, the combustion chamber having an upper end region and a lower end region, a circulation conduit disposed outside the combustion chamber and connected between the upper end region and the lower end region of the combustion chamber for circulating the fluidized bed, a feeding point connected to the circulation conduit for feeding a portion of the fuel into the circulation conduit, the circulation conduit having a fuel degasification and gasification zone formed therein in the vicinity of the feeding point, a removal point disposed along the circulation conduit for removing combustible gas from the circulation conduit, the removal point being disposed in the fuel degasification and gasification zone, and a combustor of the gas turbine plant in which air required for operation of the gas turbine plant is heated by combustion of combustible gas, and a combustible gas line connected between the removal point and the combustor. Although in the present instance the degasification or gasification zone is located outside the actual combustion chamber of the fluidized bed furnace, it is nevertheless part of the fluidized bed furnace. The particular advantage here is that while the structure remains simple, no additional provisions need be made for supplying the fuel with the heat required for gasification or degasification.

In accordance with an additional feature of the invention, the circulation conduit includes a a hood-like enlargement at which the removal point is disposed. This is particularly favorable for accumulating the combustible gas.

In accordance with yet another feature of the invention, the enlargement is disposed downstream of the feeding point, as viewed in the direction of circulation in the circulation conduit.

In accordance with yet a further feature of the invention, there is provided another chamber incorporated into the circulation conduit and having another stationary fluidized bed therein, a fuel delivery point for feeding a portion of the solid fuel required for the operation of the plant into the other fluidized bed, and a pipeline for feeding oxygen-poor gas, preferably exhaust gas, from a fluidized bed furnace to the other fluidized bed as a fluidizing medium and for at least partial degasification of the fuel. Very good results in terms of combustible gas production are attained when a second stationary fluidized bed, in which combustible gas is produced, is installed in the circulation conduit. Regarding the oxygen-poor gas for degasification and for generating the fluidized bed, here again, the delivery of the heat required for the degasification of the fuel is particularly simple. This simplicity is also characteristic of how the degasified fuels are removed from the second fluidized bed, because this removal is effected by means of the ash and fuel components that are circulating in the circulation conduit and are part of the fluidized bed that is required for the operation of the steam power plant.

In accordance with a concomitant feature of the invention, there is provided a combustible gas accumulation chamber disposed above the other fluidized bed and communicating with the combustor, the circulation conduit having a first segment introduced vertically from above into the other fluidized bed and discharging within the other fluidized bed, an overflow barrier laterally limiting the other fluidized bed and having a height determining the thickness of the other fluidized bed in the vertical direction, and the circulation conduit having a second segment leading out of the other chamber and being connected to the overflow barrier.

Other features which are considered as characteristic for the invention are set forth in the appended claims.

Although the invention is illustrated and described herein as embodied in a combined gas turbine and steam power plant having a fluidized bed furnace for generating electrical energy, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
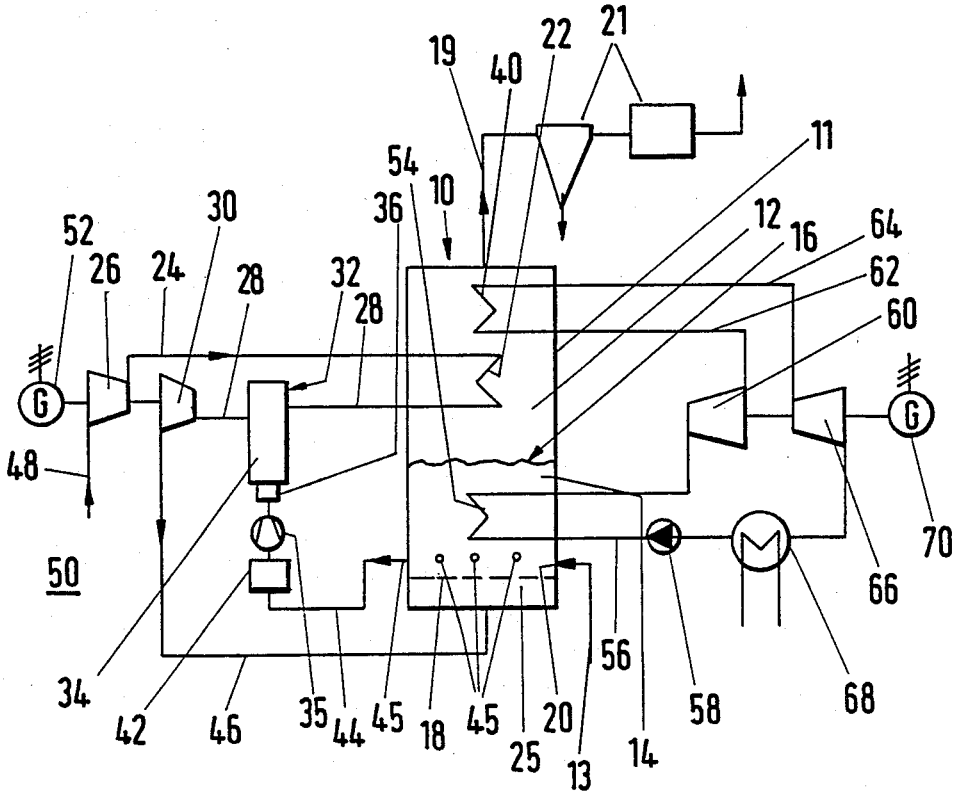
FIG. 1 is a schematic circuit diagram of a combined gas turbine and steam power plant according to the invention.

Referring now to the figures of the drawings in detail and first, particulary, to FIG. 1 thereof, there is seen a steam power plant of a combined gas turbine and steam power plant, which is provided with a fluidized bed furnace identified as a whole by reference numeral 10. A housing 11 which contains the fluidized bed furnace, has a vertical combustion chamber 12 with a lower region in which the fluidized bed 14 is disposed. The fluidized bed has a defined surface 16 inside the combustion chamber 12, so that it is a stationary fluidized bed. The combustion chamber is preferably circular in cross section and is surrounded by a vertical combustion chamber wall.

In order to form the stationary fluidized bed 14, solid fuel material in small pieces is delivered by a feed apparatus and a line 13 to a fuel delivery point 20 above a horizontal nozzle or tuyere bottom 18, located in the lower end region. The solid fuel material is preferably hard coal, brown coal or oil-bearing shale having a particle size from 0.5 to 15 mm. The spacing between the nozzle bottom 18 and the fuel delivery point 20 is approximately from 1/20 to 1/5 and preferably from $\frac{1}{8}$ to 1/5 of the vertical thickness of the fluidized bed 14. The fuel is suitably mixed with additives such as dolomite or limestone in small pieces, so that sulfur components introduced along with the fuel into the combustion chamber, can be bound during the combustion process in the fluidized bed. The nozzle bottom 18 disposed in the lower region of the combustion chamber 12 has a multiplicity of openings formed therein, through which the combustion air or fluidizing air is supplied to the fluidized bed. A non-illustrated outlet for removing ash components also leads downward from the nozzle bottom 18 to the exterior. An exhaust gas duct 19 connected to the upper end of the combustion chamber 12, leads to a non-illustrated chimney by way of an exhaust gas scrubber 21 containing dust removers, cleaners and a nitrogen removing device for removal of nitrogen oxides, if required.

A heat exchanger 22, which may be in the form of pipe coils, is provided above the fluidized bed 14 in the combustion chamber 12. The heat exchanger 22 has one end communicating through a pipeline 24 with the pressure side of an ambientair compressor 26 of the gas turbine plant and another end connected through a pipeline 28 to the inlet of an expansion turbine 30.

Another combustion chamber or combustor 32 is incorporated into the pipeline 28. The air is heated directly in the combustor 32, i.e. it mixed with hot flue gases and then delivered to the turbine 30. Combustible or fuel gas for a gas burner 36, which is a component of the combustor, is drawn through a combustible gas line 44 from the combustion chamber 12 of the fluidized bed furnace. To this end, at least one and preferably from four to eight openings 45 are provided in the combustion chamber wall. The opening 45 is suitably disposed in the vicinity of the horizontal fuel delivery plane. The opening 45 is circular and has a diameter that is equal to from 1/20 to 1/10 of the diameter of the combustion chamber. The fuel delivery plane extends through the fuel delivery point 20; the opening 45 is disposed in a region which has a vertical extension equal to from 1/5 to 1/15 of the vertical thickness of the fluidized bed 14. In order to provide for uniform removal of the combustible gases from the combustion chamber, a ring line preferably extends around the vertical combustion chamber wall and communicates with a plurality of openings 45 disposed approximately uniformly on the combustion chamber wall. The openings are located in a horizontal plane. The combustible gas line 44 is then connected to the ring line, which is not shown in FIG. 1. In order to keep solid particles entrained by the combustible gas from reaching the gas burner 36 and thus from reaching the turbine 30, a filter device 42 is inserted into the combustible gas line 44. The solids retained in the filter device are returned to the fluidized bed furnace. The combustible gas that is cleaned in the filter device 42 is compressed in a compressor 35, fed into the gas burner 36 and burned in the combustion chamber 34 of the combustor 32.

The outlet of the turbine 30 communicates by way of a combustion air line 46 with a space 25 in the fluidized bed furnace that is located below the nozzle bottom 18 and has a vertical height that is equal to from $\frac{1}{4}$ to 1/5 of the vertical thickness of the fluidized bed 14. The intake or suction side of the compressor 26 communicates with the environment 50 through an intake line 48. The shaft of the compressor 26 is coupled to the shaft of the turbine 30 and it is also coupled to the shaft of a generator 52, which converts the excess energy into electric current.

The steam plant shown in highly simplified form in FIG. 1 has an evaporator 54, which is disposed in or optionally above the fluidized bed 14 and receives feedwater from a feedwater pump 58 through a pipeline 56. The steam that is generated is delivered to a high-pressure steam turbine 60, where it is partly expanded and it is carried through a pipeline 62 to a reheater 40. The reheater is located in the upper end region of the combustion chamber 12, above the heat exchanger 22 and the fluidized bed 14. The evaporator 54 and the reheater 40 are preferably in the form of pipe coils. The reheated steam is delivered through a pipeline 64 to a low-pressure steam turbine 66, where it is expanded and then liquified in a condenser 68. The resultant condensate is delivered to the feedwater pump 58, for closed-cycle circulation. The two turbines 60 and 66 are coupled by means of their shafts and they drive an electric generator 70.

During operation of the plant, ambient air is aspirated by the compressor 26 through the intake line 48 and advantageously through a filter; the air is compressed and is delivered through the pipeline 24 to the heat exchanger 22. In the heat exchanger 22, the compressed air is heated by means of the flue gases of the fluidized bed furnace and is delivered through the pipeline 28 and the combustor 32 to the turbine 30. In the turbine, the heated air is expanded and then is delivered as combustion air through the combustion air line 46 to the space 25 and thus to the fluidized bed 14. Since the combustion air still has an overpressure of approximately 0.2 to 1 bar, the fuel becomes turbulent and therefore the fluidized bed 14 is formed by means of the combustion air.

For adequate desulfuration and for suppressing the formation of nitrogen oxides, the fluidized bed furnace must be operated at a temperature of no more than 850 to 950 degrees C. Therefore, the compressed air in the heat exchanger 22 can only be heated to a correspondingly low temperature of approximately 500 to 750 degrees C., yet this temperature is too low for economical operation of the turbine 30. Therefore, this air is reheated in the combustor 32 after leaving the heat exchanger 22, to the extent necessary for optimal operation of the turbine 30 and to the extent permissible for operation of the turbine in view of its mechanical strength. The air is heated in the combustor to a temperature of approximately 900 to 1000 degrees C.

In order to reheat the air, the combustor 32 is fired by means of at least one gas burner 36, which draws its combustible gas from the fluidized bed furnace through the combustible gas line 44. To this end, the combustible gas line 44 is connected to the combustion chamber in a zone of the fluidized bed 14 in which gaseous fuel is produced by the gasification or degasification of the solid fuel, for example pieces of coal. This zone is typically located directly above the plane in which the solid fuel is delivered at the delivery point 20. Although as much air is introduced into the combustion chamber 12 through the nozzle bottom 18 as the fuel fluidized in the fluidized bed 14 will completely burn, combustible gases are nevertheless produced in the above-mentioned zone by degasification or gasification of the supplied fuel. The heat required for this purpose is furnished by the fluidized bed 14. The resultant combustible gas contains $CH_4$, CO, $H_2$ as well as $N_2$ and $CO_2$, among others.

The compressed air flowing from the heat exchanger 22 is heated further by means of the firing of the combustible gas in the combustor 32, while being mixed with the exhaust gases from combustion, and the compressed air is delivered to the turbine 30. After the expansion of the mixture of combustor exhaust gas and compressed air in the turbine 30, this oxygen-containing mixture is introduced into the space 25 through the combustion air line 46 as combustion air and fluidizing air. The air then flows upward through the openings in the nozzle bottom 18, makes the fuel turbulent and thus effects the formation of the fluidized bed 14. The fluidized bed 14 accordingly is formed of the turbulent fuel which burns completely in the fluidized bed. The solid fuel material required is introduced into the combustion chamber 12 through a line at the fuel delivery point 20, together with the additives such as dolomite or lime. Spent components of the fuel such as ash, are drawn off through a non-illustrated line. The exhaust gases flow upward in the combustion chamber, give up heat at the individual heat exchangers 54, 22, 40 and are carried through the exhaust gas duct 19 which is in the form of a pipeline, through the exhaust gas scrubber 21, to a non-illustrated chimney. The mechanical energy given off by the turbine 30 serves to drive the compressor 26; the remaining energy is converted into electric current in the electric generator 52.

During operation of the steam power plant, the feedwater which has been supplied is evaporated and superheated in a known manner in the evaporator 54, and the resultant high-pressure steam is delivered to the high-pressure turbine 60. After a partial expansion, the steam is superheated again in the reheater 40, delivered through the pipeline 64 to the low-pressure steam turbine 66, expanded and liquefied in the condenser 68. The energy attained is given to a power grid up in the form of electrical energy by the generator 70.

The efficiency of the turbine 30 and thus of the entire plant is increased substantially by the reheating of the compressed air in the combustor 32. Since the combustor exhaust gases are introduced in their entirety into the fluidized bed, damage to the environment from these exhaust gases is avoided in a simple and inexpensive manner. Due to the generation of the combustible gas inside the fluidized bed from the fuel thereof, the operating costs are reduced even further and operation of the plant is simplified. A substantial advantage is therefore that the invention greatly reduces the operating costs of the combined plant.

Figure 2:
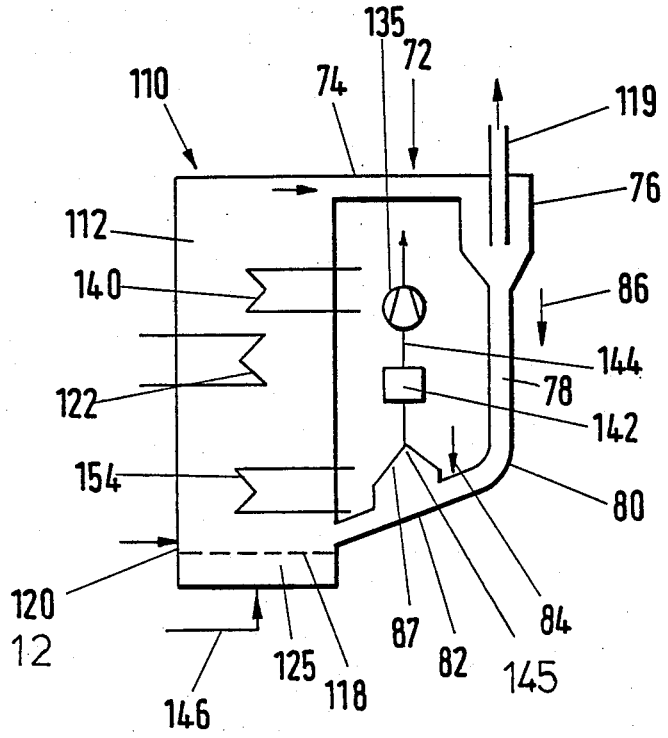
FIG. 2 is a circuit diagram showing another embodiment of the invention in the vicinity of the fluidized bed furnace of FIG. 1.

FIG. 2 shows a detailed view of another embodiment of the region of the fluidized bed furnace 10 of FIG. 1.

Individual elements that reappear in FIG. 2 are identified with the same reference numerals as in FIG. 1, with an increase of 100. The fluidized bed furnace according to FIG. 2, which is identified as a whole by reference numeral 110, has a combustion chamber 112 that again extends vertically and has a preferably circular cross section, in which an evaporator 154 of the steam power plant, a heat exchanger 122 for heating the compressed air and a reheater 140 of the steam power plant are disposed one above the other. In the lower region of the combustion chamber 112, a nozzle bottom 118 is again provided, its openings connecting the combustion chamber to a space 125 located below it. A combustion air line 146 which delivers the expanded mixture formed of combustor exhaust gas and air from the expansion turbine to the fluidized bed in the form of combustion gas, discharges into the space 125. Above the nozzle bottom 118, a delivery point 120 for the delivery of the fuel to the combustion chamber 112 can also be seen. An outlet line for spent fuel is not shown, for the sake of simplicity. Such a line would lead to the outside from the lower portion of the combustion chamber 112.

Since the fluidized bed furnace 110 is intended for operation with a circulating fluidized bed, the upper end portion of the combustion chamber 112 communicates with the lower end portion by means of a circulation conduit 72 extending outside the combustion chamber 112. The circulation conduit preferably has a circular cross section. The cross section amounts to approximately from 10 to 25% of the cross section of the combustion chamber 112. The circulation conduit has a segment 74, which extends horizontally from the upper end of the combustion chamber 12 and discharges into a cyclone trap 76. An exhaust gas duct 119, which leads to the exhaust gas scrubber that is not shown in FIG. 2, is connected to the central, upwardly extending outlet tube of the cyclone trap. A vertically extending segment 78 of the circulation conduit 72, which merges at a bend 80 with a segment 82 leading into the combustion chamber 112, is connected to the lower portion of the conical cyclone trap 76, which tapers to a point. The segment 82 extends with a descending grade from the bend 80 to the combustion chamber 112 and discharges into the combustion chamber 112 in the vicinity of the nozzle bottom 118, preferably directly above the nozzle bottom. The bend has an angle of approximately 110 to 130 degrees.

During operation, the air flows through the nozzle bottom 118 into the combustion chamber 112 and causes turbulence in the fuel delivered in small pieces to the delivery point 120; the result is a fluidized bed which fills the entire combustion chamber 112 and effects the complete combustion of the fuel. Furthermore, the fluidized bed disposed in the combustion chamber 112 and formed of particles of fuel, circulates from the upper end region of the combustion chamber 112, through the circulation conduit 72 and downward into the region directly above the nozzle bottom 118; therefore, it is a circulating fluidized bed. The exhaust gases are separated from the solid components in the cyclone trap 76 and are removed through the exhaust gas duct 119.

A feeding point 84 for fluidized bed fuel is provided in the segment 82 of the circulation conduit, downstream of the bend 80, as seen in the circulation direction 86. The feeding point 84 is located on the top of the segment 82. An upwardly extending hood-like enlargement 87 of the segment 82 is provided downstream of but in the immediate vicinity of the feeding point. A combustible gas line 144 leading to the combustor 32 of the gas turbine plant is connected to a removal point 145 in the form of an opening, at the highest point of the enlargement 87. The combustible gas line 144 includes a filter device 142 and a compressor 135. The combustor is not shown. The enlargement 87 has a height and a maximum width that are each approximately 2 to 3 times the diameter of the circulation conduit 72. The enlargement 87 also tapers upward to a point at which the combustible gas line 144 is connected. The spacing between the feeding point 84 and the enlargement is approximately 0.5 to 1.5 times the diameter of the circulation conduit 72.

During operation, the non-degasified fluidized bed firing fuel delivered to the feeding point 84, in particular coal in small pieces, is entrained by means of particles of coal and ash in the circulating fluidized bed that are circulating in the circulation conduit in the direction of the arrow 86 and heated.

As a result, gasification or degasification of this fuel takes place and the resultant combustible gas accumulates in the hood-like enlargement 87 and is drawn off through the combustible gas line 144 and delivered to the combustor of the gas turbine plant. The degasified residues of the supplied fuel are then introduced into the combustion chamber 112 together with the particles of coal and ash, where they burn together with the fuel delivered at the fuel delivery point 120. The circulation of the fluidized bed through the combustion chamber 112 and the circulation conduit 72 is effected by means of the oxygen-containing mixture of combustor exhaust gas and air delivered by means of the combustion air line 146; this mixture enters the combustion chamber 112 from the space 125 through the nozzle bottom 118. This mixture also brings about the combustion in the combustion chamber.

It is favorable for only as much fuel as is required for generating the combustible gas to be delivered to the feeding point 84. The remaining non-degasified fuel in this case is delivered directly to the combustion chamber 112 at the delivery point 120.

The operation of the steam power plant and gas turbine 20 plant proceeds as in the embodiment according to FIG. 1, so that further explanation is not needed here.

Figure 3:
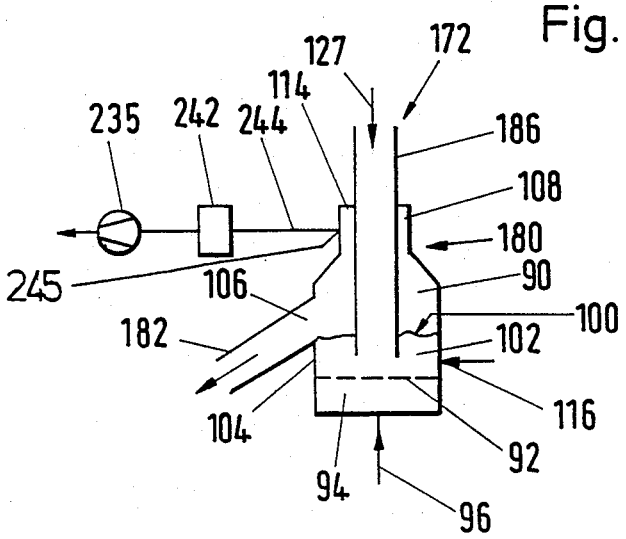
FIG. 3 is a circuit diagram of a further embodiment of the invention in a particular part of the gasification-degasification area of the FIG. 2 embodiment.

FIG. 3 shows details of the area of the segments 78, 82 and the bend 80 of the circulation conduit of FIG. 2 in the form of a further embodiment, shown on a larger scale. Individual elements of FIG. 2 that are also present in FIG. 3 are again identified in FIG. 3 by reference numerals that are increased by 100 as compared to those of FIG. 2.

A stationary second fluidized bed 102 is inserted in the vicinity of a bend 180 of the circulation conduit 172, for the production of the combustible gas by degasification of fluidized bed firing fuel; this second fluidized bed operates similarly to the fluidized bed 14 of FIG. 1. The second fluidized bed 102 is in the form of a vertical chamber 90 preferably having a circular cross section, in the lower region of which a nozzle bottom 92, provided with a multiplicity of openings, is horizontally disposed. A pipeline 96 discharges into a chamber 94 provided underneath the nozzle bottom 92. The pipeline 96 is connected to the exhaust gas duct of the system which is identified in FIG. 1 by reference numeral 19, with the interposition of a blower or compressor. The connection is preferably made downstream of the exhaust gas scrubber that is provided but not shown in FIG. 3.

A vertically extending straight segment 186 of a circulation conduit 172 is preferably centrally introduced into the chamber 90, far enough so that the mouth of the segment 186 is located in the stationary, second fluidized bed 102 and is spaced apart from the nozzle bottom 92 by a distance that is approximately from $\frac{1}{2}$ to $\frac{1}{4}$ of the vertical thickness of the fluidized bed 102. The stationary second fluidized bed is located immediately above the nozzle bottom 92 and has a defined surface 100. The segment 182 of the circulation conduit that returns to the combustion chamber of the steam generator with a descending grade, is connected to a vertical side wall of the chamber 90. The vertical portion of the side wall that is located between a connection point 106 of the segment 182 and the nozzle bottom 92 forms an overflow barrier 104. As FIG. 3 shows, the height of the overflow barrier 104 determines the vertical thickness of the stationary second fluidized bed 102; that is, the thickness of the fluidized bed can be selected by means of a suitable height of the overflow barrier.

The upper end portion of the chamber 90 forms a combustible gas accumulation chamber 108. To this end, the upper end portion of the chamber 90 tapers conically toward the segment 186 introduced centrally into the chamber 90 and merges with a chamber 114 annularly surrounding the segment 186, this chamber 114 forming the actual combustible gas accumulation chamber 108. Finally, a combustible gas line 244 leading to the combustor of the gas turbine plant is connected to the combustible gas accumulation chamber at an outlet or removal point 245 in the form of at least one opening. A filter device 242 along with a compressor 235 is advantageously incorporated into the combustible gas line 244. A feeding point 116 for feeding fuel to the chamber 90 and through which fluidized bed fuel can be delivered to the second fluidized bed 102, is disposed directly above the nozzle bottom 92.

During operation of the plant, the circulation conduit 172 has circulating ash and coke components of the fluidized bed furnace flowing through it, just as in the embodiment according to FIG. 2. These components pass through the segment 186 into the chamber 90, they fill the chamber 90 beginning at the nozzle bottom 92 up to the connection point 106, then flow over the overflow barrier 104 and are returned through the segment 182 having a descending grade to the combustion chamber of the fluidized bed furnace of the steam generator, as seen in FIG. 1. The height of the vertically extending overflow barrier 104 in this case determines the thickness of the bed forming on the nozzle bottom 92, which forms the fluidized bed 102. It should be noted that the segment 186 of the circulation conduit protrudes into the fluidized bed 102 and discharges there.

At the fuel delivery point 116, fluidized bed furnace fuel intended for the production of combustible gas is introduced into the second fluidized bed 102. In order to form the second fluidized bed, oxygen-poor gas having an oxygen content of no more than 5% by volume, preferably exhaust gas that is drawn from the exhaust gas duct of the fluidized bed furnace of the steam generator, is delivered though the pipeline 96, so that the introduced fuel cannot burn but instead is only degasified. Since the second fluidized bed 102 is incorporated into the circulation conduit 172 of the fluidized bed furnace of the steam generator, the heat required for the degasification of the fuel is introduced into the second fluidized bed 102 by means of the circulating hot ash and coke particles. The resultant flammable gas flows upward into the combustible gas accumulation chamber 108, where it is drawn off through the combustible gas line 244 and delivered as combustible gas to the combustor of the gas turbine plant through the filter device 242 and the compressor 235. The degasified fuel flows together with the ash and coke particles of the circulation conduit 172 through the segment 182 of the fluidized bed furnace serving to generate steam. Preferably only as much fuel as is required for generating the necessary combustible gas for the combustor is delivered. The remaining fuel required for operation of the system is then introduced directly into the fluidized bed furnace of the steam generator. In some cases, however, it can be more favorable to feed in all the fuel required for the operation of the combined gas turbine and steam power plant to the second fluidized bed 102 at the fuel delivery point 116 and thus to feed it into the circulation conduit 172, the circulation of which carries the fuel on into the fluidized bed furnace 10 of the steam generator seen in FIG. 1.

The foregoing is a description corresponding in substance to German Application P No. 36 13 300.0, dated Apr. 19, 1986, the International priority of which is being claimed for the instant application, and which is hereby made part of this application. Any material discrepancies between the foregoing specification and the aforementioned corresponding German application are to be resolved in favor of the latter.

What is claimed:

1. Combined gas turbine and steam power plant for generating electrical energy, comprising:

a combustion chamber for the complete combustion of solid fuels with the aid of a stationary fluidized bed in said combustion chamber;

said combustion chamber having as zone in the fluidized bed forming during operation of the fluidized bed in which combustible gas is produced by gasification or degasification of the solid fuels, means for generating steam for the steam power plant, a nozzle bottom, a fuel delivery point above said nozzle bottom, and a vertical wall with at least one opening formed therein in said zone above said delivery point for the removal of combustible gas; and a combustor of the gas turbine plant in which compressed air required for the operation of the gas turbine is heated, and a combustible gas line connected between said at least one opening and said combustor for supplying combustible gas to be burned in said combustor for heating the compressed air.

2. Plant according to claim 1, wherein said at least one opening is in the form of a plurality of openings disposed substantially along a horizontal plane and uniformly distributed about the periphery of said combustion chamber wall.

3. Plant according to claim 1, wherein said fluidized bed has a given vertical thickness, and said at least one opening is vertically spaced from said fuel delivery point by substantially between 1/5 and 1/15 of said given vertical thickness.

* * * * *